US007270943B2

(12) United States Patent
Muryama et al.

(10) Patent No.: US 7,270,943 B2
(45) Date of Patent: Sep. 18, 2007

(54) COMPOSITIONS, SYSTEMS, AND METHODS FOR IMAGING

(75) Inventors: Tetsuo Muryama, Yokohama (JP); Makoto Ochi, Tokyo (JP); Kanzi Shimizu, Kokohama (JP); Cari L. Dorsh, McMinnville, OR (US); Vladek Kasperchik, Corvallis, OR (US); William E. Dorogy, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 203 days.

(21) Appl. No.: 10/887,145

(22) Filed: Jul. 8, 2004

(65) Prior Publication Data

US 2006/0009356 A1 Jan. 12, 2006

(51) Int. Cl.

| | |
|---|---|
| ***G03C 1/685*** | (2006.01) |
| ***G03C 1/73*** | (2006.01) |
| ***G03C 1/765*** | (2006.01) |
| ***G03C 5/16*** | (2006.01) |

(52) U.S. Cl. ..... 430/337; 430/338; 430/964; 503/209

(58) Field of Classification Search ..... 430/337, 430/338, 964; 503/209

See application file for complete search history.

(56) References Cited

U.S. PATENT DOCUMENTS

| | | | | |
|---|---|---|---|---|
| 4,620,205 | A | 10/1986 | Iiyama | |
| 4,731,354 | A | 3/1988 | Taniguchi et al. | |
| 4,742,043 | A | 5/1988 | Tanaka | |
| 4,845,072 | A | 7/1989 | Furuya et al. | |
| 4,942,107 | A | 7/1990 | Saeki et al. | |
| 4,966,883 | A | 10/1990 | Anderson et al. | |
| 5,043,313 | A | 8/1991 | Mori et al. | |
| 5,096,873 | A | 3/1992 | Minami et al. | |
| 5,155,037 | A | 10/1992 | Summers | |
| 5,354,724 | A | 10/1994 | Hoffmann et al. | |
| 5,646,088 | A | 7/1997 | Hada et al. | |
| 5,703,006 | A | 12/1997 | Mori et al. | |
| 5,741,592 | A | 4/1998 | Lewis et al. | |
| 5,824,715 | A | 10/1998 | Hayashihara et al. | |
| 6,180,560 | B1 | 1/2001 | Hayakawa et al. | |
| 6,395,680 | B1 | 5/2002 | Morita et al. | |
| 6,642,175 | B2 | 11/2003 | Mitsuo et al. | |
| 6,645,910 | B1 * | 11/2003 | Sato et al. | 503/209 |
| 6,818,592 | B2 * | 11/2004 | Watanabe et al. | 503/208 |
| 6,972,272 | B2 * | 12/2005 | Iwasaki et al. | 503/216 |
| 7,135,431 | B2 * | 11/2006 | Iwasaki et al. | 503/209 |
| 7,141,360 | B2 | 11/2006 | Kasperchik et al. | |
| 2002/0065195 | A1 * | 5/2002 | Mitsuo et al. | 503/209 |
| 2003/0153460 | A1 | 8/2003 | Morita et al. | |
| 2003/0186810 | A1 | 10/2003 | Kato et al. | |
| 2004/0146812 | A1 * | 7/2004 | Gore et al. | 430/343 |
| 2005/0053863 | A1 * | 3/2005 | Gore | 430/270.14 |

(Continued)

FOREIGN PATENT DOCUMENTS

| | | |
|---|---|---|
| TW | 200540559 | 12/2005 |

*Primary Examiner*—Richard L. Schilling

(57) ABSTRACT

Imaging layers, image recording media, and methods of preparation of each, are disclosed. One exemplary embodiment of the imaging layer, among others, includes a matrix; a radiation absorbing compound dissolved in the matrix; an aromatic compound dissolved in the matrix; a color former; and an activator. One of the activator and the color former is dissolved in the matrix and the other of the activator and the color former is substantially insoluble in the matrix at ambient conditions and is substantially uniformly distributed in the matrix.

16 Claims, 2 Drawing Sheets

U.S. PATENT DOCUMENTS

2005/0089782 A1* 4/2005 Kasperchik et al. ..... 430/66
2005/0100817 A1* 5/2005 Kasperchik et al. ..... 430/270.1
2005/0277070 A1* 12/2005 Kasperchik et al. ..... 430/332

* cited by examiner

COMPOSITIONS, SYSTEMS, AND METHODS FOR IMAGING

BACKGROUND

Materials that produce color change upon stimulation with energy such as light or heat may have possible applications in imaging. For example, such materials may be found in thermal printing papers and instant imaging films. Generally, the materials and compositions known so far may require a multifilm structure and further processing to produce an image (e.g., instant imaging films such as Polaroid). And in the case of facsimile and thermal head media, high energy input of greater than 1 J/cm$^2$ is needed to achieve good images. The compositions in multifilm media may require control of diffusion of color-forming chemistry and further processing, and are in separate phases and layers. Most thermal and facsimile paper coatings consist of coatings prepared by preparing fine dispersions of more than two components. The components mix and react upon application of energy, resulting in a colored material. To the necessary mixing, the particles need to contact across three or more phases or layers (e.g., in a thermochromic system the reactive components are separated by the barrier phase) and merge into a new phase. Because of these multiple phases and layers, high energy is required to perform this process. For example, a relatively powerful carbon dioxide laser with an energy density of 3 J/cm$^2$ at times of much greater than 100 μs may be needed to produce a mark. In some instances, this high energy application may cause damage to the imaging substrate. In many situations, it may be desirable to produce a visible mark more efficiently using either a less intense, less powerful, and/or shorter energy application. Therefore, there is a need for fast marking coatings, possibly composed of fewer than three phases and in single layer.

SUMMARY

Briefly described, embodiments of this disclosure include imaging layers, image recording media, and methods of preparation of each. One exemplary embodiment of the imaging layer, among others, includes a matrix; a radiation absorbing compound dissolved in the matrix; an aromatic compound dissolved in the matrix; a color former; and an activator. One of the activator and the color former is dissolved in the matrix and the other of the activator and the color former is substantially insoluble in the matrix at ambient conditions and is substantially uniformly distributed in the matrix.

One exemplary embodiment of the image recording media, among others, includes a substrate having a two-phase layer disposed thereon. The two-phase layer includes a matrix; a radiation absorbing compound dissolved in the matrix; an aromatic compound dissolved in the matrix; a color former; and an activator. One of the activator and the color former is dissolved in the matrix and the other of the activator and the color former is substantially insoluble in the matrix at ambient conditions and is substantially uniformly distributed in the matrix.

One exemplary embodiment of the method for preparing an imaging material, among others, includes, providing a matrix, a radiation absorbing compound, an aromatic compound, a color former, and an activator, wherein one of the color former and the activator is substantially dissolved in the matrix at ambient conditions and the other is substantially insoluble in the matrix; dissolving the radiation absorbing compound, the aromatic compound, and one of the color former and the activator that is soluble in the matrix at ambient conditions, in the matrix; and distributing the other of the color former and the activator substantially uniformly in the matrix.

BRIEF DESCRIPTION OF THE DRAWINGS

Many aspects of this disclosure can be better understood with reference to the following drawings. The components in the drawings are not necessarily to scale. Moreover, in the drawings, like reference numerals designate corresponding parts throughout the several views.

DETAILED DESCRIPTION

Embodiments of the disclosure include two-phase layers, methods of making the two-phase layers, and methods of using the two-phase layers. The two-phase layer includes aromatic compounds (e.g., in some embodiments weakly acidic phenolic compounds) dissolved in a matrix material (hereinafter "matrix") to stabilize a color after the image is formed within the matrix. Image fade typical for many color formers (e.g., leuco dyes) is related to crystallization of the color former from the colored amorphous glassy phase, therefore stabilization of the glassy phase of color former can retard image fade. The two-phase layer can be a coating disposed onto a substrate and used in structures such as, but not limited to, paper, digital recording material, and the like.

In addition, one component (e.g., a color former or an activator) is substantially soluble in the matrix, while the other is substantially insoluble in the matrix at ambient temperature. A clear mark and excellent image quality can be obtained by directing radiation energy (e.g., a 780 nm laser operating at 45 MW) at areas of the two-phase layer. In an illustrative example the components used to produce the mark via a color change upon stimulation by energy can include a color former (e.g., a fluoran leuco dye) dispersed in the matrix as separate phase and an activator (e.g., a sulphonylphenol compound) dissolved in a matrix such as a radiation-cured acrylate polymer.

In particular embodiments, either the color former or the activator may be substantially insoluble in the matrix at ambient conditions, while the other component is substantially soluble in the matrix. A radiation energy absorber (e.g., an antenna) is also present in the two-phase layer. The radiation energy absorber functions to absorb energy, convert the energy into heat, and deliver the heat to the reactants. The energy may then be applied by the way of an infrared laser. Upon application of the energy, both the activator (i.e., substantially dissolved in the matrix), and the color-former (i.e., which is not substantially dissolved in the matrix) may become heated and mix, which causes the color-former to become activated and cause a mark (color) to be produced.

Figure 1:
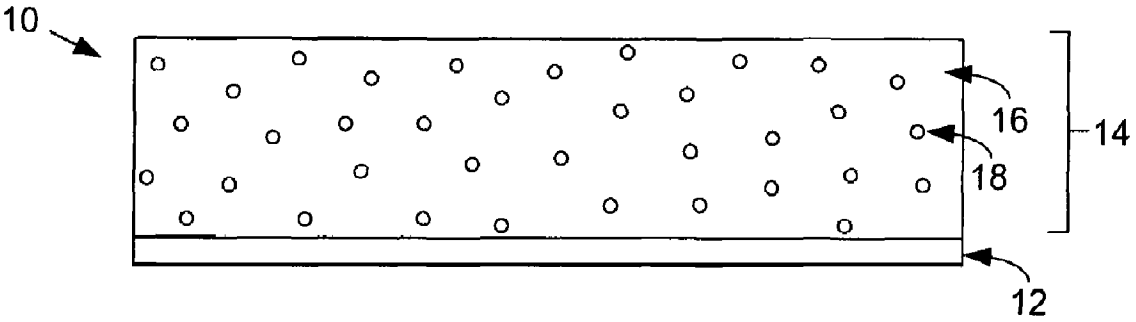
FIG. 1 illustrates an illustrative embodiment of the imaging medium.

FIG. 1 illustrates an embodiment of an imaging medium 10. The imaging medium 10 can include, but is not limited to, a substrate 12 and a two-phase layer 14. The substrate 12 may be a substrate upon which it is desirable to make a mark, such as, but not limited to, paper (e.g., labels, tickets, receipts, or stationary), overhead transparencies, a metal/ metal composite, glass, a ceramic, a polymer, and a labeling medium (e.g., a compact disk (CD) (e.g., CD-R/RW/ROM) and a digital video disk (DVD) (e.g., DVD-R/RW/ROM).

The two-phase layer 14 can include, but is not limited to, a matrix 16, an activator, a radiation absorbing compound (not shown, substantially dissolved in the matrix), an aromatic compound (not shown, substantially dissolved in the matrix), and a color former.

The activator and the color former, when mixed upon heating (e.g., both are substantially dissolved in the matrix 16), may change color to form a mark. Either of the activator and the color former may be soluble in the matrix 16. The other component (activator or color former) may be substantially insoluble in the matrix 16 and may be suspended in the matrix 16 as substantially uniformly distributed insoluble particles 18.

In one embodiment, the activator is substantially dissolved in the matrix 16, while the color former is substantially insoluble in the matrix 16. In this embodiment, the color former is an insoluble particle 18 substantially uniformly distributed within the matrix 16 of the two-phase layer 14.

The two-phase layer 14 may be applied to the substrate 12 via any acceptable method, such as, but not limited to, rolling, spraying, and screen-printing. In addition, one or more layers can be formed between the two-phase layer 14 and the substrate 12 and/or one or more layer can be formed on top of the two-phase layer 14. In one embodiment, the two-phase layer 14 is part of a CD or a DVD.

To form a mark, radiation energy is directed imagewise at one or more discrete areas of the two-phase layer 14 of the imaging medium 10. The form of radiation energy may vary depending upon the equipment available, ambient conditions, the desired result, and the like. The radiation energy can include, but is not limited to, infrared (IR) radiation, ultraviolet (UV) radiation, x-rays, and visible light. The radiation absorbing compound absorbs the radiation energy and heats the area of the two-phase layer 14 to which the radiation energy impacts. The heat may cause suspended insoluble particles 18 to reach a temperature sufficient to cause the melting and subsequent diffusion into the matrix phase of the color former initially present in the insoluble particles 18 (e.g., glass transition temperatures ($T_g$) or melting temperatures ($T_m$) of insoluble particles 18 and matrix). Apart from melting the matrix the heat also reduces the matrixes melt viscosity, and accelerates the diffusion rate of the color-forming components (e.g., leuco-dye and activator), thus speeding up the color formation rate. The activator and color former may then react to form a mark (color) on certain areas of the two-phase layer 14.

Figure 2:
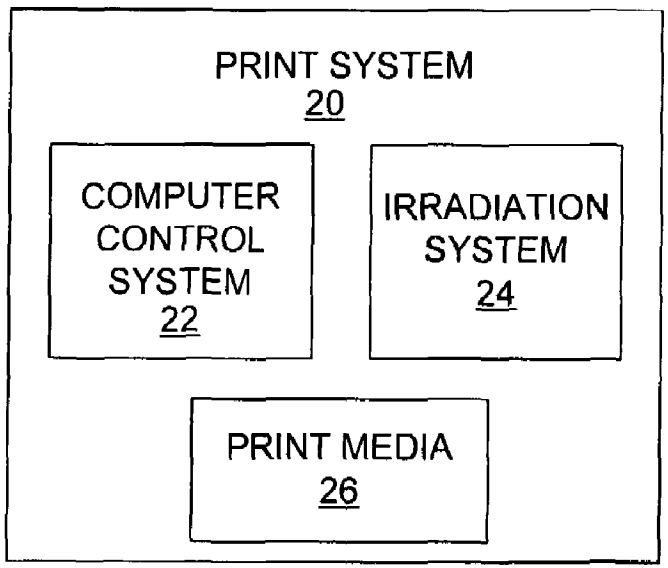
FIG. 2 illustrates a representative embodiment of a printer system.

FIG. 2 illustrates a representative embodiment of a print system 20. The print system 20 can include, but is not limited to, a computer control system 22, an irradiation system 24, and print media 26 (e.g., imaging medium). The computer control system 22 is operative to control the irradiation system 24 to cause marks (e.g., printing of characters, symbols, photos, and the like) to be formed on the print media 26. The irradiation system 24 can include, but is not limited to, a laser system, UV energy system, IR energy system, visible energy system, x-ray system, and other systems that can produce radiation energy to cause a mark to be formed on the two-phase layer 14. The print system 20 can include, but is not limited to, a laser printer system and an ink-jet printer system. In addition, the print system 20 can be incorporated into a digital media system. For example, the print system 20 can be operated in a digital media system to print labels (e.g., the two-phase layer is incorporated into a label) onto digital media such as CDs and DVDs. Furthermore, the print system 20 can be operated in a digital media system to directly print onto the digital media (e.g., the two-phase layer is incorporated the structure of the digital media).

The matrix 16 can include compounds capable of and suitable for dissolving and/or dispersing the radiation absorbing compound, the aromatic compound, the activator, and/or the color former. The matrix 16 can include, but is not limited to, UV curable monomers, oligomers, and pre-polymers (e.g., acrylate derivatives. Illustrative examples of UV-curable monomers, oligomers, and pre-polymers (that may be mixed to form a suitable UV-curable matrix) can include but are not limited to, hexamethylene diacrylate, tripropylene glycol diacrylate, lauryl acrylate, isodecyl acrylate, neopentyl glycol diacrylate, 2-phenoxyethyl acrylate, 2(2-ethoxy)ethylacrylate, polyethylene glycol diacrylate and other acrylated polyols, trimethylolpropane triacrylate, pentaerythritol tetraacrylate, ethoxylated bisphenol A diacrylate, acrylic oligomers with epoxy functionality, and the like.

In an embodiment the matrix 16 is used in combination with a photo package. A photo package may include, but is not limited to, a light absorbing species, which initiates reactions for curing of a matrix such as, by way of example, benzophenone derivatives. Other examples of photoinitiators for free radical polymerization monomers and pre-polymers include, but are not limited to, thioxanethone derivatives, anthraquinone derivatives, acetophenones and benzoine ether types, and the like.

It may be desirable to choose a matrix 16 that is cured by a form of radiation other than the type of radiation that causes a color change. Matrices 16 based on cationic polymerization resins may include photo-initiators based on aromatic diazonium salts, aromatic halonium salts, aromatic sulfonium salts and metallocene compounds, for example. An example of a matrix 16 may include Nor-Cote CDG000. Other acceptable matrices 16 may include, but is not limited to, acrylated polyester oligomers (e.g., CN293 and CN294, available from Sartomer Co.).

The matrix compound 16 is from about 2 wt % to 98 wt % of the two-phase layer and from about 20 wt % to 90 wt % of the two-phase layer.

The term "radiation absorbing compound" (e.g., an antenna) means any radiation absorbing compound in which the antenna readily absorbs a desired specific wavelength of the marking radiation. The radiation absorbing compound may be a material that effectively absorbs the type of energy to be applied to the imaging medium 10 to effect a mark or color change. The radiation absorbing compound can include, but is not limited to, IR780 (Aldrich 42,531-1) (1) (3H-Indolium, 2-[2-[2-ylidene)ethylidene]-1-cyclohexen-1-yl]ethenyl]-3,3-dimethyl-1-propyl-, iodide (9CI)), IR783 (Aldrich 54,329-2)(2)(2-[2-[2-Chloro-3-[2-[1,3-dihydro-3,3-dimethyl-1-(4-sulfobutyl)-2H-indol-2-ylidene]-ethylidene]-1-cyclohexen-1-yl]-ethenyl]-3,3-dimethyl-1-(4-sulfobutyl)-3H-indolium hydroxide, inner salt sodium salt), Syntec 9/1 (3)), Syntec 9/3 (4) or metal complexes (e.g., dithiolane metal complexes (5) and indoaniline metal complexes (6)) may be suitable radiation absorbing compounds:

(1)

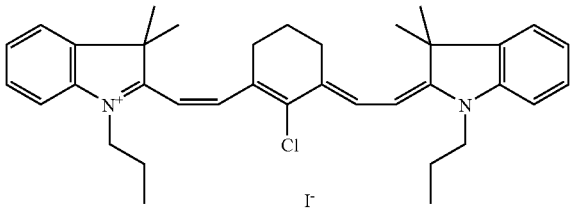

(2)

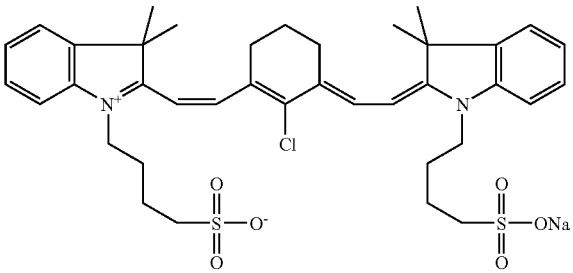

(3)

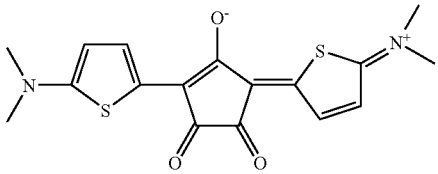

(4)

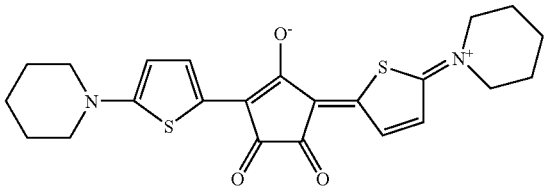

(5)

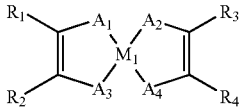

where $M_1$ is a transition metal, $R_1$, $R_2$, $R_3$, and $R_4$ are alkyl or aryl groups with or without halo substituents, and $A_1$, $A_2$, $A_3$, and $A_4$ can be S, NH, or Se;

(6)

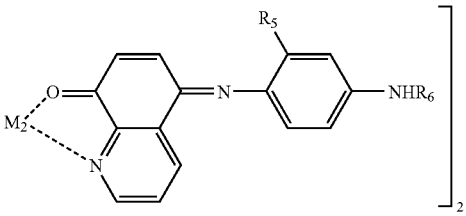

where $M_2$ is Ni or Cu and $R_5$ and $R_6$ are aryl or alkyl groups with or without halo substituents.

Additional examples of radiation absorbing compounds can be found in "Infrared Absorbing Dyes", Matsuoka, Masaru, ed., Plenum Press (1990) (ISBN 0-306-43478-4) and "Near-infrared Dyes for High Technology Applications", Daehne, S.; Resch-Genger, U.; Wolfbeis, O., Ed., Kluwer Academic Publishers (ISBN 0-7923-5101-0), both incorporated herein by reference.

The radiation absorbing compound is from about 0.01 wt % to 10 wt % of the two-phase layer and from about 0.1 wt % to 3 wt % of the two-phase layer.

As used herein, the term "activator" is a substance that reacts with a color former and causes the color former to alter its chemical structure and change or acquire color. The activators may include, but is not limited to, proton donors and acidic phenolic compounds (e.g., benzyl hydroxybenzoate, bisphenol-A and bisphenol-S) as well as derivatives thereof (e.g., D8(4-Hydroxyphenyl-4'-isopropoxyphenyl sulfone), TG-SA(Bis(4-hydroxy-3-allylphenyl) sulfone) and polyphenols. The activator is from about 1 wt % to 40 wt % of the two-phase layer and from about 3 wt % to 25 wt % of the two-phase layer.

The term "aromatic compound" means a compound capable of preserving/stabilizing the glassy phase of the color former and, thus, retarding the crystallization of a color former (e.g., leuco dye) and preventing color-fading in the imaged area. Image fade typical for many leuco dyes is related to leuco dye crystallization, therefore stabilization of the glassy phase of the color former can retard image fade. The aromatic compound can include, but is not limited to, a thiophenols, a weakly acidic phenol, an aromatic aminosulfones, and combinations thereof. The aromatic color-stabilizing compound is from about 0.1 wt % to 10 wt % of the two-phase layer and from about 1 wt % to 6 wt % of the two-phase layer.

The thiophenol can include compounds described by the following formula:

(7)

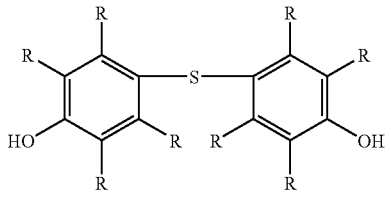

where each R can independently be an alkyl group or a hydrogen atom. In particular, the alkyl group is a methyl group, an ethyl group, a butyl group, or a combination thereof. More specifically, the thiophenol can include, but is not limited to, 4,4'-thiobis[6-tert-butyl-3-methylphenol].

The weakly acidic phenol can include compounds described by the following formula:

(8)

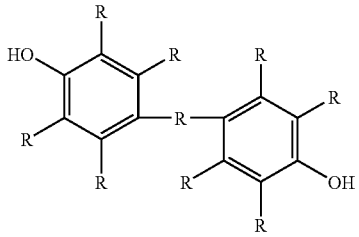

where each R, can independently be an alkyl group or a hydrogen atom. In particular, the alkyl group is a methyl group, an ethyl group, a propyl group, a butyl group, a tert-butyl group, or a combination thereof. More specifically, the phenol can include, but is not limited to, 4,4-butylidene bis-(6-tert-butyl-m-cresol).

The aromatic aminosulfone can include compound described by the following formula.

(9)

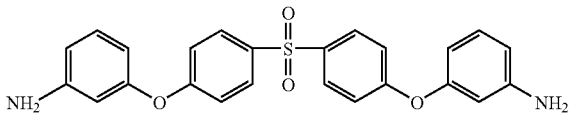

In particular, the aromatic aminosulfone can include, but is not limited to, Bis[4-(3-aminophenoxy)phenyl] sulfone and derivatives thereof.

The term "color former" is a color forming substance, which is colorless or one color in a non-activated state and produces or changes color in an activated state. The color former can include, but is not limited to, leuco dyes and phthalide color formers (e.g., fluoran leuco dyes and phthalide color formers as described in "The Chemistry and Applications of Leuco Dyes", Muthyala, Ramiah, ed., Plenum Press (1997) (ISBN 0-306-45459-9), incorporated herein by reference). Examples of fluoran leuco dyes include the structure shown in Formula (10)

(10)

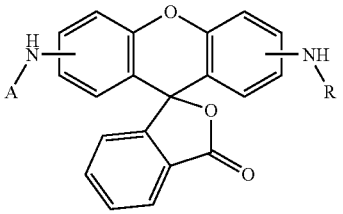

where A and R are aryl or alkyl groups. The color former is from about 1 wt % to 80 wt % of the two-phase layer and from about 5 wt % to 50 wt % of the two-phase layer.

The activator (e.g., bisphenol-A) and color former (e.g., Black-400, (Yamada Chemical Co., Ltd. in Japan)) may act in tandem to produce a mark. The activator and color former may be two substances that when reacted together produce a color change. When reacted, the activator may initiate a color change in the color former or develop the color former. One of the activator and the color former may be substantially soluble in the matrix 16 at ambient conditions, while the other may be substantially insoluble in the matrix 16 at ambient conditions.

By "substantially insoluble," it is meant that the solubility of the color former or the activator in the matrix 16 at ambient conditions is so low, that no or very little color change may occur due to reaction of the color former and the activator at ambient conditions.

By "substantially soluble," it is meant that the solubility of one of the color former or the activator in the matrix 16 at ambient conditions is high, that all or most of the color former or the activator present in the two-phase formulation is dissolved in the matrix 16.

Although, in the embodiments described above, the activator may be dissolved in the matrix 16 and the color former remains suspended as a substantially insoluble particle in the matrix 16 at ambient conditions, it is also acceptable that the color former may be dissolved in the matrix 16 and the activator may remain as a substantially insoluble particle at ambient conditions.

Figure 3:
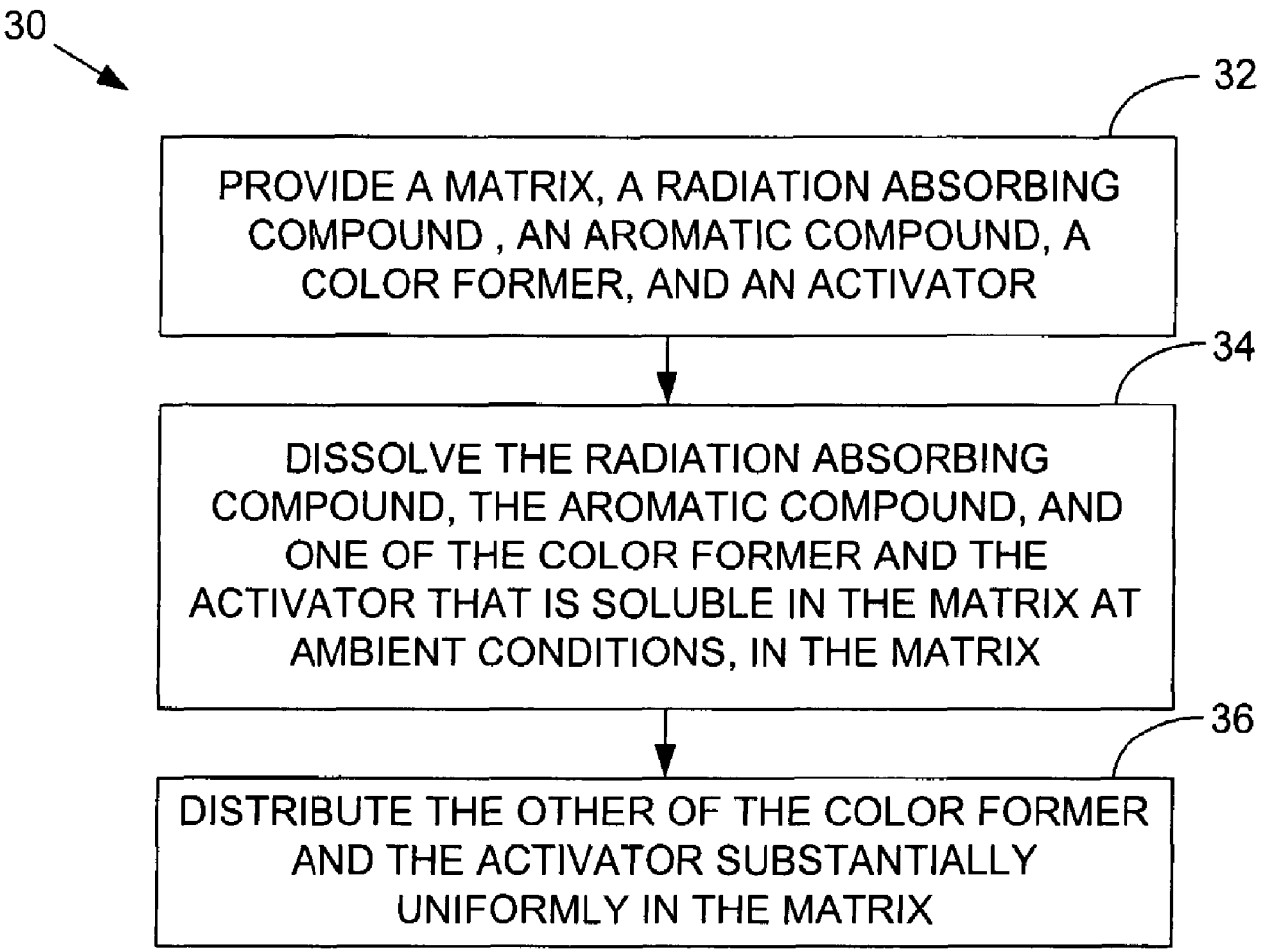
FIG. 3 illustrates a representative process for making an embodiment of a two-phase layer.

FIG. 3 illustrates a representative process 30 for making the two-phase layer 14. In block 32, the matrix 16, the radiation absorbing compound dissolved in the matrix 16, the aromatic compound dissolved in the matrix 16, the color former, and the activator, are provided. One of the color former and the activator is substantially soluble in the matrix 16 at ambient conditions, while the other is substantially insoluble in the matrix 16. In block 34, the radiation absorbing compound, the aromatic compound, and one of the color former and the activator that is soluble is dissolved in the matrix 16 at ambient conditions. In block 36, the other of the color former and the activator is distributed substantially uniformly in the matrix 16. Subsequently, the two-phase layer 14 can be disposed on a substrate 12 to form the imaging medium 10.

EXAMPLE 1

About one to two grams of dibenzyl oxalate was heated to melting (about 85° C.). About twenty grams of activator bisphenol-A and about one gram of antenna IR780 were dissolved in the melted dibenzyl oxalate while temperature of the melt was raised to about 150 to 160° C. The activator/antenna alloy was cooled and ground into a fine powder.

About five grams of the ground activator/antenna alloy powder and about one gram of 4,4'-thiobis[6-tert-butyl-3-methylphenol](trade name "Yoshinox SR", (API Corporation in Japan)), were dissolved in 15.3 g Nor-Cote CDG000 UV-lacquer (i.e., a mixture of UV-curable acrylate monomers and oligomers) to form the lacquer/antenna/activator solution.

About ten grams of m-terphenyl (accelerator) was melted in a beaker. The melt was heated to about 110° C. About one hundred grams of BK400 was added in small increments to the melt upon constant stirring. The added BK-400 is a leuco-dye (2'-anilino-3'-methyl-6'-(dibutylamino)fluoran) available from Nagase Corporation, the structure of which is set forth below as Formula 11:

(11)

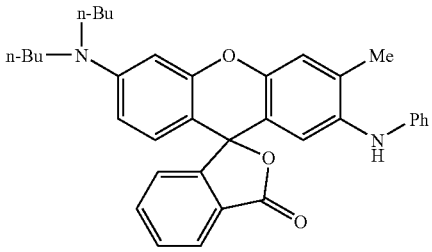

The temperature of the mixture was increased up to about 170 to 180° C. Stirring was continued until complete dissolution of BK400 in the melt (usually takes about 10-15 min) was obtained to form an accelerator/leuco-dye solution. About 550 mg of IR780 (IR dye) was added to the melt upon constant stirring. IR780 iodide, also known as 3H-Indolinium, 2-[2-chloro-3-[91,3-dihydro3,3-dimethyl-1-propyl-2H-indol-2-ylidene)ethylidene]-1-cyclohexen-1yl] ethenenyl]-3,3-dimethyl-1-propyl-, iodide(9CI), has the following formula:

(12)

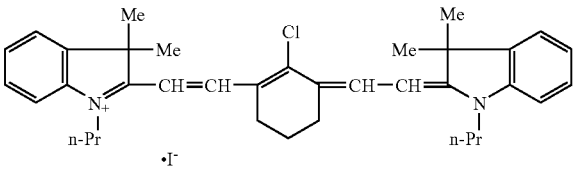

Heating and stirring was continued for about two to three additional minutes until the IR dye was completely dissolved in the melt to form a leuco-dye/antenna/accelerator alloy (eutectic). The temperature of the leuco-dye/antenna/accelerator alloy was kept to below about 190° C.

The leuco-dye/antenna/accelerator alloy was then poured into a pre-cooled freezer tray lined with aluminum foil. The solidified melt was milled into a coarse powder and then attrition-ground in the aqueous dispersion until the average volume-weighted particle size of the ground alloy was less than about 2 μm. The ground alloy was dried in a vacuum to form a leuco-dye eutectic powder.

The mixture of leuco-dye/antenna/accelerator alloy and lacquer/antenna/activator/stabilizer solution was formed into a UV-curable paste and screen printed onto a substrate at a thickness of approximately about 5 to about 9 μm to form an imaging medium. The coating on the medium was then UV cured by mercury lamp.

Direct marking was effected on the resulting coated substrate with a 45 mW laser. A mark of approximately 20 μm×45 μm was produced with duration of energy applications of about 30 μsec to 150 μsec. Direct marking occurs when the desired image is marked on the imaging medium, without the use of a printing intermediary.

The above discussion is meant to be illustrative of the principles and various embodiments of the present disclosure. Numerous variations and modifications will become apparent to those skilled in the art once the above disclosure is fully appreciated. It is intended that the following claims be interpreted to embrace all such variations and modifications.

What is claimed is:

1. An imaging layer comprising:

a matrix;

a radiation absorbing compound dissolved in the matrix;

an aromatic compound dissolved in the matrix, wherein the aromatic compound is Bis[4-(3-aminophenoxy) phenyl] sulfone;

a color former; and an activator, wherein one of the activator and the color former is dissolved in the matrix and the other of the activator and the color former is substantially insoluble in the matrix at ambient conditions and is substantially uniformly distributed in the matrix.

2. The imaging layer of claim 1, wherein the color former is substantially insoluble in the matrix at ambient temperature and the activator is substantially dissolved in the matrix.

3. The imaging layer of claim 1, wherein the aromatic aminosulfone includes the formula:

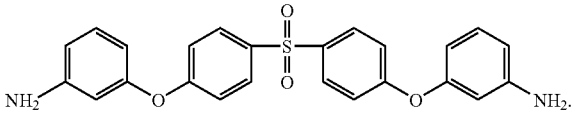

4. The imaging layer of claim 1, wherein the color former is substantially insoluble in the matrix and the activator is dissolved in the matrix.

5. The imaging layer of claim 1 wherein the color former comprises at least one compound chosen from a leuco dye and a phthalide dye.

6. The imaging layer of claim 1 wherein the matrix is selected from an ultraviolet curable monomer, an ultraviolet oligomers, pre-polymers of a ultraviolet polymer, and combinations thereof.

7. The imaging layer of claim 1 wherein the activator is selected from acidic phenolic compounds and derivatives thereof and polyphenol compounds.

8. The imaging layer of claim 1 wherein the a radiation absorbing compound comprises at least one of the compounds chosen from quinone, phthalocyanine, naphthalocyanine, metal complexes, azo, croconium, squarilium dyes, hexafunctional polyester oligomers, and the compounds represented by the following formulae:

(A)

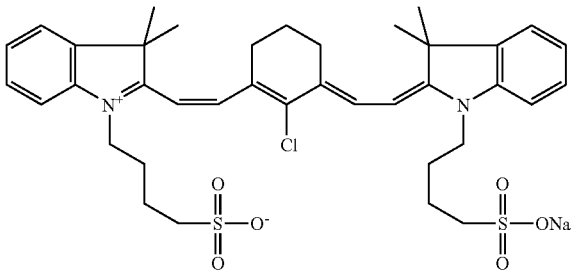

(B)

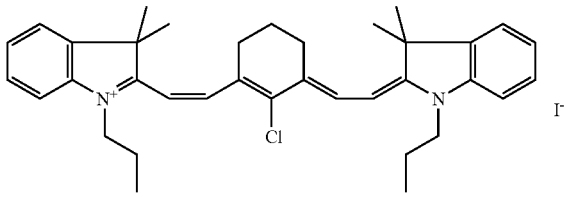

(C)

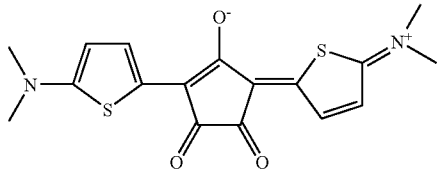

(D)

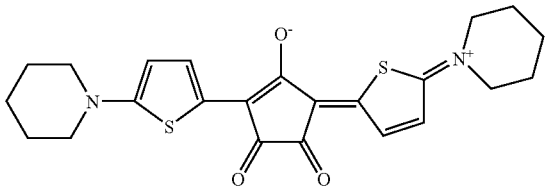

9. An image recording medium comprising:

a substrate having a two-phase layer disposed thereon, wherein the substrate is selected from a compact disk (CD) and a digital video disk (DVD), wherein the two-phase layer includes:

a matrix;

a radiation absorbing compound dissolved in the matrix;

an aromatic compound dissolved in the matrix, wherein the aromatic compound is Bis[4-(3-aminophenoxy) phenyl] sulfone;

a color former; and an activator, wherein one of the activator and the color former is dissolved in the matrix and the other of the activator and the color former is substantially insoluble in the matrix at ambient conditions and is substantially uniformly distributed in the matrix.

10. The image recording medium of claim 9, wherein the substrate is selected from a CD-R/RW/ROM and DVD-R/RW/ROM.

11. The image recording medium of claim 9, wherein the color former is substantially insoluble in the matrix at ambient temperature and the activator is substantially dissolved in the matrix.

12. The image recording medium of claim 9, wherein the matrix is from about 2 wt % to 98 wt % of the two-phase layer, wherein the radiation absorbing compound is from about 0.01 wt % to 10 wt % of the two-phase layer, wherein the aromatic compound is from about 0.1 wt % to 10 wt % of the two-phase layer, wherein the color former is from about 1 wt % to 80 wt % of the two-phase layer, and wherein the activator is from about 1 wt % to 40 wt % of the two-phase layer.

13. The image recording medium of claim 9, wherein the matrix is from about 20 wt % to 90 wt % of the two-phase layer, wherein the radiation absorbing compound is from about 0.1 wt % to 3 wt % of the two-phase layer, wherein the aromatic compound is from about 1 wt % to 6 wt % of the two-phase layer, wherein the color former is from about 5 wt % to 50 wt % of the two-phase layer, and wherein the activator is from about 3 wt % to 25 wt % of the two-phase layer.

14. A method for preparing an imaging material, the method comprising:

providing a matrix, a radiation absorbing compound, an aromatic compound, a color former, and an activator, wherein one of the color former and the activator is substantially dissolved in the matrix at ambient conditions and the other is substantially insoluble in the matrix, wherein the aromatic compound is Bis[4-(3-aminophenoxy)phenyl]sulfone;

dissolving the radiation absorbing compound, the aromatic compound, and one of the color former and the activator that is soluble in the matrix at ambient conditions, in the matrix;

distributing the other of the color former and the activator substantially uniformly in the matrix; and disposing the direct imaging material onto a substrate, wherein the substrate is selected from a compact disk (CD) and a digital video disk (DVD).

15. The method of claim 14, wherein the color former is substantially insoluble in the matrix and the activator is dissolved in the matrix.

16. An image recording medium made by the method of claim 14.

* * * * *

UNITED STATES PATENT AND TRADEMARK OFFICE

CERTIFICATE OF CORRECTION

PATENT NO. : 7,270,943 B2
APPLICATION NO. : 10/887145
DATED : September 18, 2007
INVENTOR(S) : Tetsuo Muryama et al.

It is certified that error appears in the above-identified patent and that said Letters Patent is hereby corrected as shown below:

In column 4, line 59, delete "2-[2-[2-ylidene)" insert
-- 2-[2-[2-chloro-3-[(1,3-dihydro-3,3-dimethyl-1-propyl-2H-indol-2-ylidene) --.

In column 10, line 22, in Claim 8, after "the" delete "a".

Signed and Sealed this

Fifth Day of August, 2008

JON W. DUDAS
*Director of the United States Patent and Trademark Office*